US008565663B2

(12) United States Patent
Naito et al.

(10) Patent No.: US 8,565,663 B2
(45) Date of Patent: Oct. 22, 2013

(54) CONVEYING APPARATUS AND IMAGE FORMING APPARATUS

(75) Inventors: Shinichi Naito, Kanagawa (JP); Hiroyuki Tanaka, Kanagawa (JP); Hiroyuki Suzuki, Kanagawa (JP); Osamu Uto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 804 days.

(21) Appl. No.: 11/727,057

(22) Filed: Mar. 23, 2007

(65) Prior Publication Data

US 2008/0038030 A1 Feb. 14, 2008

(30) Foreign Application Priority Data

Aug. 11, 2006 (JP) ..... P2006-219786

(51) Int. Cl.

| | |
|---|---|
| ***G03G 15/00*** | (2006.01) |
| ***B41J 11/38*** | (2006.01) |
| ***B65H 3/44*** | (2006.01) |
| ***B65H 11/00*** | (2006.01) |

(52) U.S. Cl.
USPC ..... 399/392; 271/9.09

(58) Field of Classification Search
USPC ..... 399/361, 381, 388, 392; 271/9.09
IPC ..... B41J 13/10,11/38; B64H 3/44
See application file for complete search history.

(56) References Cited

U.S. PATENT DOCUMENTS

| | | | | |
|---|---|---|---|---|
| 5,241,353 | A * | 8/1993 | Maeshima et al. | 399/405 |
| 6,470,160 | B1 * | 10/2002 | Murakami | 399/124 |
| 6,873,822 | B2 | 3/2005 | Tomono et al. | |
| 7,631,861 | B2 * | 12/2009 | Takahashi | 271/9.09 |
| 7,708,263 | B2 * | 5/2010 | Yano et al. | 271/9.09 |
| 2002/0039508 | A1 * | 4/2002 | Tsusaka et al. | 399/401 |
| 2005/0062217 | A1 * | 3/2005 | Asada | 271/162 |
| 2005/0163548 | A1 * | 7/2005 | Kojima | 399/393 |
| 2005/0254873 | A1 * | 11/2005 | Murakami et al. | 400/55 |
| 2006/0198675 | A1 * | 9/2006 | Yamamoto | 399/392 |

FOREIGN PATENT DOCUMENTS

| | | | |
|---|---|---|---|
| JP | 61-267646 | | 11/1986 |
| JP | 62012531 | A * | 1/1987 |
| JP | 62140944 | A * | 6/1987 |
| JP | 05004727 | A * | 1/1993 |
| JP | 05043066 | A * | 2/1993 |
| JP | 5-92846 | | 4/1993 |
| JP | 06305584 | A * | 11/1994 |
| JP | 08104449 | A * | 4/1996 |
| JP | 8-272260 | | 10/1996 |

(Continued)

OTHER PUBLICATIONS

Machine translation of JP 11171360 A, Mar. 11, 2010, Japan Patent Office Web Site.*

(Continued)

*Primary Examiner* — Ren Yan
*Assistant Examiner* — Nguyen Q Ha
(74) *Attorney, Agent, or Firm* — Sughrue Mion, PLLC

(57) ABSTRACT

A conveying apparatus has a conveying apparatus main body; and a feeding device including a placement portion that a conveyed material is placed on and a feeding portion that feeds the conveyed material into the conveying apparatus main body, the feeding device being movable between a feedable position and a stored position; and the placement portion and the feeding portion moving relatively to each other between the feedable position and the stored position.

3 Claims, 6 Drawing Sheets

(56) References Cited

FOREIGN PATENT DOCUMENTS

| | | | | |
|---|---|---|---|---|
| JP | 09030658 | A | * | 2/1997 |
| JP | 09118453 | A | * | 5/1997 |
| JP | 10-69185 | | | 3/1998 |
| JP | 10218436 | A | * | 8/1998 |
| JP | 11100134 | A | * | 4/1999 |
| JP | 11171360 | A | * | 6/1999 |
| JP | 11246063 | A | * | 9/1999 |
| JP | 2000226140 | A | * | 8/2000 |
| JP | 2001019176 | A | * | 1/2001 |
| JP | 2002284371 | A | * | 10/2002 |
| JP | 2003182874 | A | * | 7/2003 |
| JP | 2003237954 | A | * | 8/2003 |
| JP | 2004-69770 | | | 3/2004 |
| JP | 2004075334 | A | * | 3/2004 |
| JP | 2005-035683 | | | 2/2005 |
| JP | 2005255316 | A | * | 9/2005 |
| JP | 2005298166 | A | * | 10/2005 |
| JP | 2005-348257 | | | 12/2005 |
| JP | 2006062183 | A | * | 3/2006 |
| JP | 2006062848 | A | * | 3/2006 |

OTHER PUBLICATIONS

Machine translation of JP 06305584 A, JPO, Dec. 17, 2010.*
Machine translation of JP 08104449 A, JPO, Dec. 17, 2010.*

* cited by examiner

CONVEYING APPARATUS AND IMAGE FORMING APPARATUS

CROSS-REFERENCE TO RELATED APPLICATIONS

This application is based on and claims priority under 35 USC 119 from Japanese Patent Application No. 2006-219786 filed on Aug. 11, 2006.

BACKGROUND

1. Technical Field

The present invention relates to a conveying apparatus having an conveying apparatus main body and a feeding device, and an image forming apparatus which includes the conveying apparatus.

2. Related Art

Conventionally, there is known a manual sheet feeding device which includes a tray in which recording media are placed and a conveying portion for feeding recording media placed in the tray piece by piece into an image forming main body.

SUMMARY

According to an aspect of the invention, there is provided a conveying apparatus having a conveying apparatus main body; and a feeding device including a placement portion that a conveyed material is placed on and a feeding portion that feeds the conveyed material into the conveying apparatus main body, the feeding device being movable between a feedable position and a stored position; and the placement portion and the feeding portion moving relatively to each other between the feedable position and the stored position.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described by reference to the accompanying drawings.

First Exemplary Embodiment

FIGS. 1 to 4 are diagrams showing a first exemplary embodiment of a feeding device of a conveying apparatus according to the invention.

Figure 1:
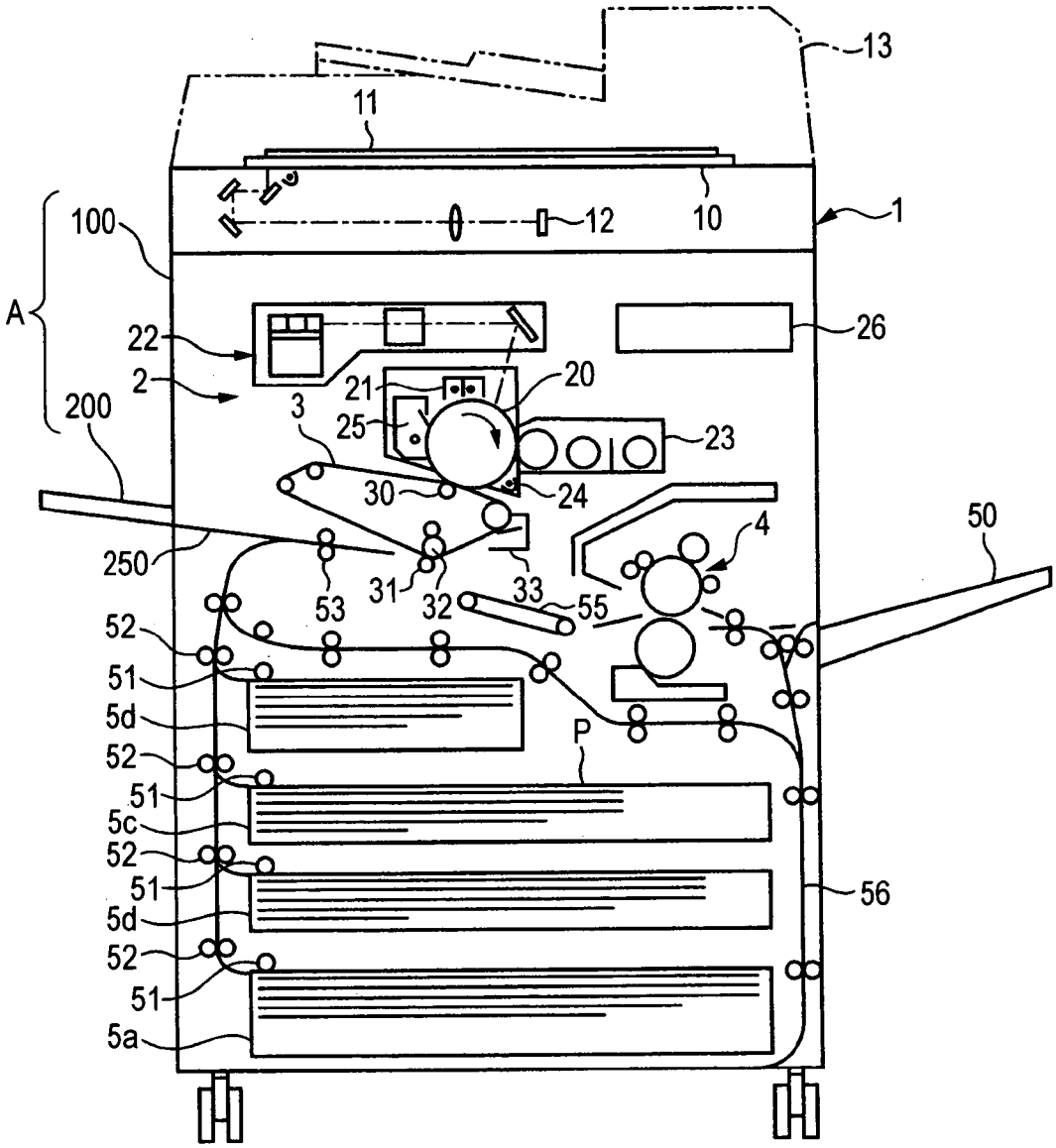
FIG. 1 depicts a diagram showing an example of an image forming apparatus to which a feeding device of a conveying mechanism of an exemplary embodiment of the invention is applied.

FIG. 1 is a diagram showing an example of an image forming apparatus to which the feeding device of the conveying apparatus of the exemplary embodiment is applied. The image forming apparatus A is made up of an image forming apparatus main body 100 and a recording medium manual feeding device 200. The image forming apparatus main body 100 has an image input unit 1 for optically reading image information of a document 11 placed on a platen 10 and converting the image information so read into electrical image data by a CCD sensor 12 and an image output unit 2 for forming an image on a sheet P based on the image data transferred from the image input unit 1, and furthermore, a automatic document feeder 13 for automatically feeding a document 11 on to the platen 10 can be mounted on the image input unit 1.

The image output unit 2 forms a recorded image on a sheet P by forming a toner image on a light-sensitive material drum 20 based on the image data transferred from the image input unit 1, thereafter primarily transferring the toner image on to an endless transfer belt 3 and furthermore secondarily transferring the toner image on the transfer belt 3 on to the sheet P, and the sheet P on to which the toner image has secondarily been transferred is designed to be discharged on to a discharge tray 50 via a fixing unit 4.

In addition, the light-sensitive material drum 20 rotates at a predetermined processing speed in a direction indicated by an arrowed line, and arranged on the periphery of the light-sensitive material drum 20 are a charging corotron 21 for uniformly charging a surface of the light-sensitive material drum 20 up to a predetermined background potential, a laser beam scanner 22 for exposing the light-sensitive material drum 20 with a laser beam which is modulated based on the image data so as to form an electrostatic latent image on the light-sensitive material drum 20, a developing unit 23 for developing the electrostatic latent image on the light-sensitive material drum 20, a pre-transfer processing corotron 24 for removing the potential on the light-sensitive material drum 20 prior to the primary transfer of the toner image on to the transfer belt 3, and a cleaner 25 for removing residual toner on the light-sensitive material drum 20 after the completion of the primary transfer to the toner image.

On the other hand, the transfer belt 3 is wound round a plurality of rollers and rotates in a direction indicated by an arrowed line, and a toner image formed on the light-sensitive material drum 20 is designed to be transferred to the transfer belt 3 to thereafter be transferred secondarily on to a recording sheet P from the transfer belt 3. A primary transfer roller 30 for forming a transfer electric field between the light-sensitive material drum 20 and itself is provided in a position which faces the light-sensitive material drum 20 across the transfer belt 3, while a secondary transfer roller 31 and an opposite electrode roller 32 are provided in a toner image secondary transfer position across the transfer belt 3, and a sheet P is passed through between the secondary transfer roller 31 and the transfer belt 3 so as to receive the transfer of a toner image. In addition, along a rotational path of the transfer belt 3, a belt cleaner 33 is provided between the secondary transfer position and the primary transfer position for removing paper dust and/or residual toner from the surface of the transfer belt 3 which has completed the secondary transfer.

In addition, a sheet feeding unit for feeding a sheet P on to the image output unit 2 is provided below the image output unit 2, and four sheet feeding trays 5*a* to 5*d*, which store sheets P in different sizes and which are arranged vertically one on another, are equipped in the sheet feeding unit. Then, a sheet P of a size selected in image forming work is designed to be conveyed from any of the sheet feeding trays 5*a* to 5*d* to the image output unit 2 by virtue of rotation of a pick-up roller 51. A plurality of sheet conveying rollers 52 are provided along a sheet P conveying path which extends between the respective sheet feeding trays 5*a* to 5*d* and the toner image secondary transfer position, and registration rollers 53 are provided immediately before the secondary transfer position, whereby the registration rollers 53 convey sheets P conveyed thereto from the sheet feeding trays 5*a* to 5*d* to the secondary transfer position at a predetermined timing which is in synchronism with a writing timing of an electrostatic latent image on to the light-sensitive material drum 20.

The feeding device 200 is provided at one side end portion of the image forming apparatus main body 100 for feeding a sheet P, which is a conveyed material, from an exterior portion of the image forming apparatus main body 100 into the image forming apparatus main body 100. In addition, a conveying passage 250 is provided in one side portion of the image forming apparatus main body 100 for conveying a sheet P from the feeding device 200 into the image forming apparatus main body 100.

In addition, in FIG. 1, reference numeral 26 denotes an image processing unit for processing the image data transferred from the image input unit 1 to the image output unit 2 according to the contents of image forming work and thereafter supplying the image data so processed to the laser beam scanner 22, reference numeral 55 denotes a sheet transfer belt for feeding a recording sheet P on to which a toner image has secondarily been transferred to the fixing unit 4, and reference numeral 56 denotes an inverter passage for, when a double-side copying is performed on a sheet P, reversing the sheet P to feed it from the fixing unit 4 to the secondary transfer position. In this exemplary embodiment, while a conveyed material transfer mechanism resides in an interior of the image forming apparatus main body 100 and is made up of the conveying passage 250, and the secondary transfer roller 31 and the sheet conveying belt 55 which follow the conveying passage 250, the configuration of the conveying mechanism is not limited thereto, and hence, any type of conveying mechanism may be adopted, provided that a resulting mechanism is such as to convey a conveyed material fed by the feeding device.

In the image forming apparatus A of the exemplary embodiment which is configured as has been described above, the laser beam scanner 22 exposes the light-sensitive material drum 20 based on image information of a document that has been captured by the image input unit 1, and an electrostatic latent image which corresponds to the image information is written on to the light-sensitive material drum 20. The development of this electrostatic latent image by the developing unit 23 is slightly delayed from the writing timing. Then, a toner image formed in this way is primarily transferred on to the transfer belt 3 by the primary transfer roller 30, and the transfer belt 3 rotates while carrying the toner image thereon. The toner image which has primarily been transferred on to the transfer belt 3 is secondarily transferred on to a sheet P conveyed from the registration rollers 53 at a predetermined timing, and the sheet P on to which the toner image, which has not yet been fixed, is transferred is discharged on to the discharge tray 50 via the fixing unit 4.

Figure 2:
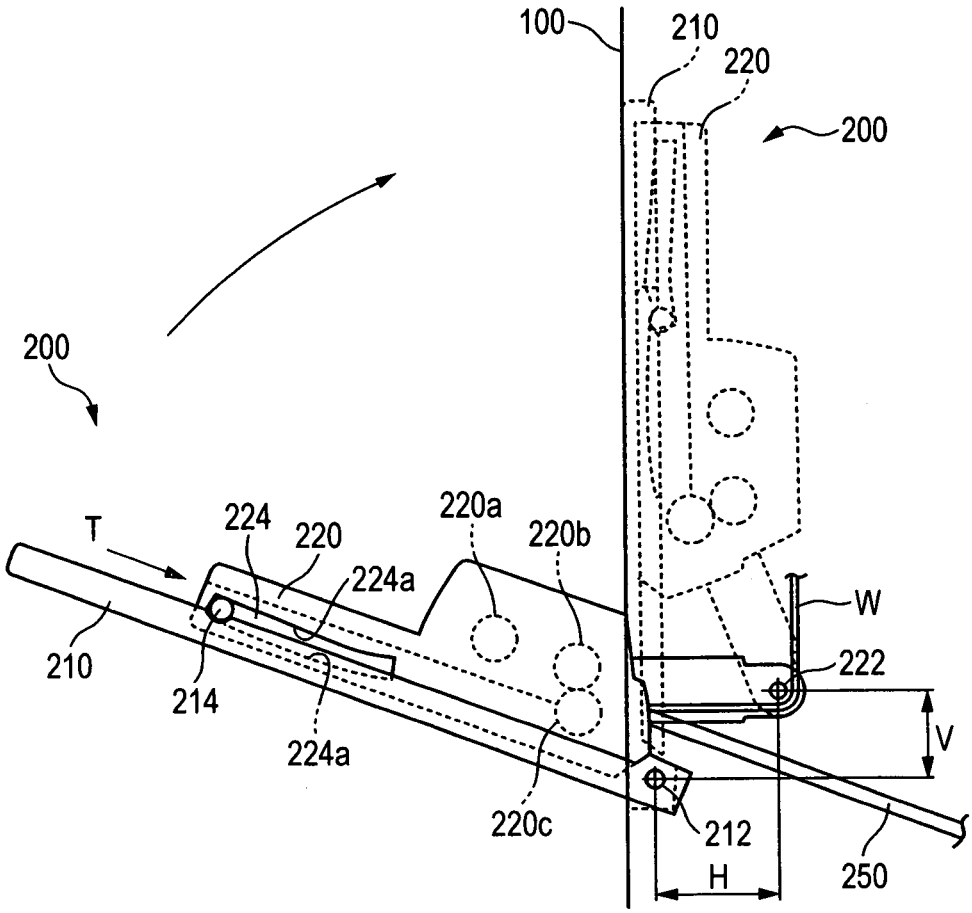
FIG. 2 is a front view showing a state in which the feeding device according to the first exemplary embodiment is installed in the image forming apparatus shown in FIG. 1.
Figure 3:
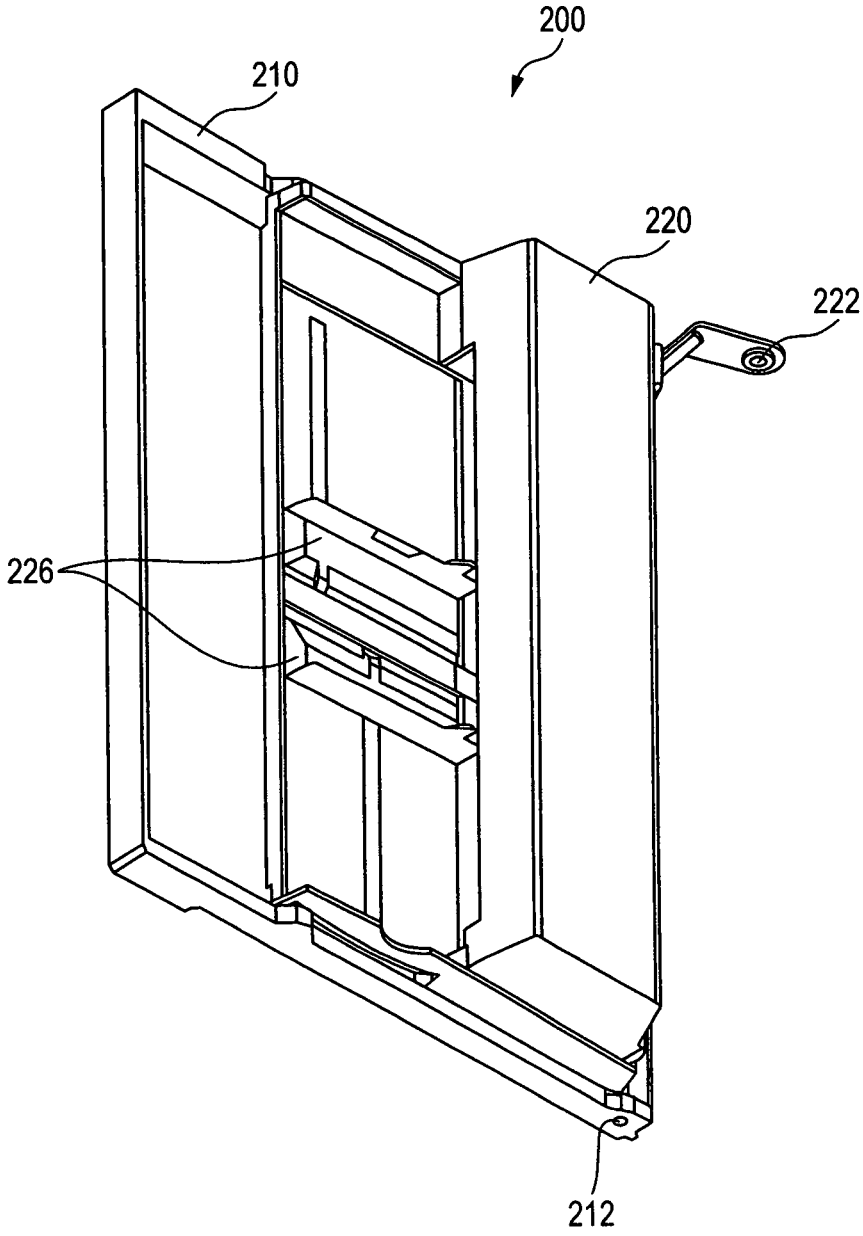
FIG. 3 is a perspective view showing the feeding device according to the first exemplary embodiment.
Figure 4:
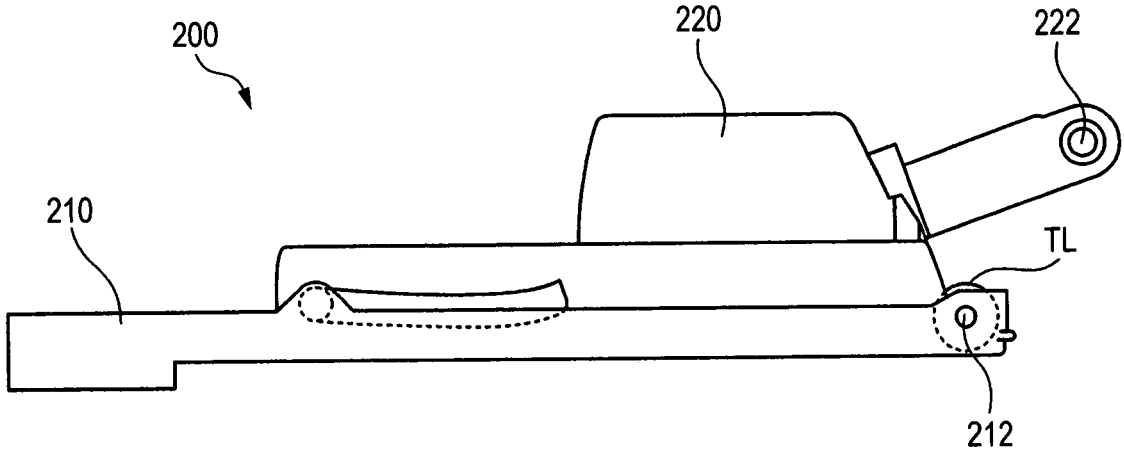
FIG. 4 is a side view showing the feeding device according to the first exemplary embodiment.

FIGS. 2 to 4 are diagrams showing the feeding device 200 of the exemplary embodiment. FIG. 2 is a front view which shows a state in which the feeding device 200 is installed on the image forming apparatus A. FIG. 3 is a perspective view which shows the feeding device 200. FIG. 4 is a side view which shows the feeding device 200.

The feeding device 200 is made up of a placement portion 210 on which sheets P are placed and a feeding portion 220 for feeding sheets P placed on the placement portion 210 into the image forming apparatus main body 100 piece by piece.

The placement portion 210 is supported on the image forming apparatus main body 100 in such a manner as to move rotationally round a first fulcrum 212 between a first position (a position when the feeding is enabled) where the placement portion 210 projects from the image forming apparatus main body 100 and a second position (a position when stored) where the placement portion 210 is stored in the image forming apparatus main body 100.

The feeding portion 220 is supported on the image forming apparatus main body 100 in such a manner as to move rotationally round a second fulcrum 222 which is spaced apart from the first fulcrum 212 by a predetermined horizontal distance H in a horizontal direction which extends from the side end portion of the image forming apparatus main body 100 to an interior thereof and by a predetermined vertical distance V in a vertically upward direction between a third position (a position when the feeding is enabled) where the feeding portion 220 projects from the image forming apparatus main body 100 for feeding sheets P placed on the placement portion 210 into the image forming apparatus main body 100 piece by piece and a fourth position (a position when stored) where the feeding portion 220 is stored in the image forming apparatus main body 100.

In addition, a pick-up roller 220*a* is provided in the feeding portion 220 for feeding a topmost sheet P of sheets placed on the placement portion 210 towards the image forming apparatus main body 100, and a feed roller 220*b* and a retarder roller 220*c* are also provided in the feeding portion 220 downstream of the pick-up roller 220*a* in the sheet P feeding direction as a so-called double-sheet detector for preventing a plurality of sheets P from being fed into the image forming apparatus main body 100 by the pick-up roller 220*a* in a superposed state.

The placement portion 210 and the feeding portion 220 are connected to each other through a sliding construction in such a manner as to move relatively to each other between the first position and the second position and the third position and the forth position, respectively, so as to move simultaneously.

The sliding construction is made up of a guide groove 224 which is formed in the feeding portion 220 and a slide pin 214 which is provided on the placement portion 210 in such a manner as to be slidably fitted in the guide groove 224 in the feeding portion 220.

The guide groove 224 is such that edges 224*a*, 224*a* which form a longitudinal direction of the guide groove 224 are each formed by two or more straight lines or a combination of a straight line and a curve so that a vertical section in a sheet P feeding direction T takes a concave shape.

The second fulcrum 222 round which the feeding portion 220 is supported in such a manner as to move rotationally relative to the image forming apparatus main body 100 is provided at one end portion of the feeding portion 220 which lies on a rear side of the image forming apparatus A.

An electric wire W, which connects a driving source (not shown) of the feeding portion 220 with the image forming apparatus main body 100 so as to drive the feeding portion 220, is laid out in such a manner as to extend along the second fulcrum 222 round which the feeding portion 220 is supported on the image forming apparatus main body 100 in such a manner as to rotate relative thereto.

In addition, a side guide mechanism 226 is provided on the feeding portion 220 for controlling a sheet P in a width direction thereof.

Additionally, a torque limiter TL is provided on the first fulcrum 212 round which the placement portion 210 is supported in such a manner as to move rotationally relative to the image forming apparatus main body 100 and/or the second fulcrum 222 round which the feeding portion 220 is supported in such a manner as to move rotationally relative to the image forming apparatus main body 100 so that a predetermined braking torque is generated when the placement portion 210 and the feeding portion 220 rotate.

The torque limiter TL is preferably such that the predetermined braking torque is generated when the placement portion 210 and the feeding portion 220 rotate from the second position and the forth position to the first position and the third position, respectively, whereas when the placement portion 210 and the feeding portion 220 rotate from the first position and the third position to the second position and the fourth position, respectively, the predetermined braking torque is not generated.

Thus, according to this exemplary embodiment, when the feeding device 200 of the image forming apparatus A is stored, the feeding device 200 of the image forming apparatus A can be stored in the image forming apparatus main body 100 without the feeding portion 220 on the feeding device 200 of the image forming apparatus A being brought into interference with the conveying passage 250 which conveys a sheet P from the feeding device 200 of the image forming apparatus A to the image output unit 2 in the image forming apparatus main body 100, thereby making it possible to realize a reduction in size of the image forming apparatus A.

In addition, the sliding construction is made up of the guide groove 224 which is formed in the feeding portion 220 and the slide pin 214 which is provided on the placement portion 210 in such a manner as to be slidably fitted in the guide groove 224 in the feeding portion 220, and the guide groove 24 is such that the edges 224*a*, 224*a* which form the longitudinal direction of the guide groove 24 are each formed by two or more straight lines or a combination of a straight line and a curve so that the vertical section in the sheet P feeding direction T takes the concave shape. Therefore, the relative displacement in the rotational direction of the placement portion 210 and the feeding portion 220 is decreased, thereby making it possible to decrease a space necessary for the placement portion 210 and the feeding portion 220 to move rotationally between the first position and the third position and the second position and the fourth position, respectively.

In addition, since the second fulcrum 222 round which the feeding portion 220 is supported in such a manner as to move rotationally relative to the image forming apparatus main body 100 is provided at one end portion of the feeding portion 220 which lies on the rear side of the image forming apparatus A, the conveying passage 250 in the image forming apparatus main body 100 and part of the whole of the image output unit 2 can be pulled out to a front side of the image forming apparatus A without interfering with the second fulcrum 222 of the feeding portion 220.

Since the electric wire W, which connects the driving source (not shown) of the feeding portion 220 with the image forming apparatus main body 100 so as to drive the feeding portion 220, is laid out in such a manner as to extend along the second fulcrum 222 round which the feeding portion 220 is supported on the image forming apparatus main body 100 in such a manner as to rotate relative thereto, in the event that the placement portion 210 and the feeding portion 220 are rotated repeatedly between the first position and the third position and the second position and the fourth position, respectively, the electric wire W which connects the drive source of the feeding portion 220 with the image forming apparatus main body 100 can be prevented from being given excessive stress.

In addition, since the side guide mechanism 226 is provided on the feeding portion 220 for regulating the sheet P in the width direction thereof, the positioning of the sheet P relative to the feeding portion 220 becomes accurate, thereby making it possible to enhance the image position accuracy.

Additionally, since the torque limiter TL is provided on the first fulcrum 212 round which the placement portion 210 is supported in such a manner as to move rotationally relative to the image forming apparatus main body 100 and/or the second fulcrum 222 round which the feeding portion 220 is supported in such a manner as to move rotationally relative to the image forming apparatus main body 100 so that the predetermined braking torque is generated when the placement portion 210 and the feeding portion 220 rotate, a drastic fall of the placement portion 210 and the feeding portion 220 can be prevented when the placement portion 210 and the feeding portion 220 rotate from the second position and the fourth position to the first position and the third position, respectively.

In the event that the torque limiter TL is made such that the predetermined braking torque is generated when the placement portion 210 and the feeding portion 220 rotate from the second position and the fourth position to the first position and the third position, respectively, whereas when the placement portion 210 and the feeding portion 220 rotate from the first position and the third position to the second position and the fourth position, respectively, the predetermined braking torque is not generated, not only can the drastic fall of the placement portion 210 and the feeding portion 220 be prevented when the placement portion 210 and the feeding portion 220 rotate from the second position and the fourth position to the first position and the third position, respectively, but also the placement portion 210 and the feeding portion 220 can be rotated from the first position and the third position to the second position and the fourth position, respectively.

Note that the invention is not limited to the exemplary embodiment that has been described heretofore but can be modified variously without departing from the spirit and scope of the invention.

For example, while in the exemplary embodiment, the placement portion 210 is supported in such a manner as to move rotationally round the first fulcrum 212 relative to the image forming apparatus main body 100, the placement portion 210 may be supported in such a manner as to move rotationally in that way using a plurality of links. It is also possible to configure the placement portion 210 in such a manner as to slide along a guide groove without using such links.

While in the exemplary embodiment, the feeding portion 220 is similarly supported in such a manner as to move rotationally round the second fulcrum relative to the image forming apparatus main body 100, as with the placement portion 210, the feeding portion 220 may be supported in such a manner as to move rotationally using a plurality of links. It is also possible to configure the feeding portion 220 in such a manner as to slide along a guide groove without using such links. In addition, it is not that the feeding portion 220 is made to move rotationally right round the second fulcrum 222 but that a link which moves rotationally round the second fulcrum 222 is provided separately from the feeding portion 220, so that the link may be connected to the feeding portion 220 in such a manner as to move rotationally. As this occurs, the first fulcrum 212 and the second fulcrum 222 do not have to be space apart from each other in the horizontal direction as in the exemplary embodiment, and the fulcrums may only have to be spaced apart from each other in the vertical direction.

While in the exemplary embodiment, the placement portion 210 and the feeding portion 220 are made to be connected to each other through the sliding mechanism, the connection of these portions is not limited to that form, and hence, for example, a link mechanism may be adopted, provided that the placement portion 210 and the feeding portion 220 are connected to move relatively to each other and move simultaneously.

Second Exemplary Embodiment

Next, a second exemplary embodiment of a feeding device for a conveying apparatus according to the invention will be described. Note that like reference numerals will be given to like configurations to those described in the first exemplary embodiment, so as to omit the description thereof.

Figure 5:
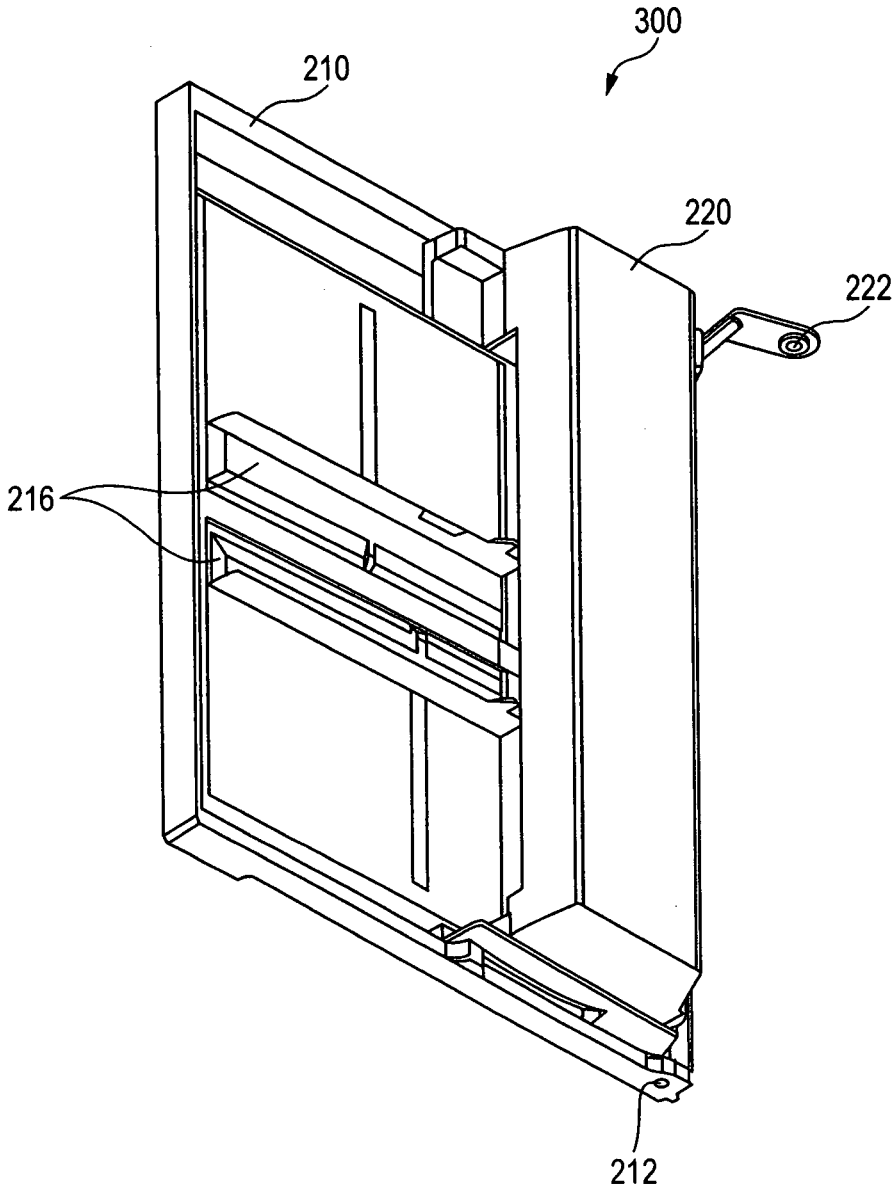
FIG. 5 is a perspective view showing a feeding device according to a second exemplary embodiment.

FIG. 5 is a perspective view showing a feeding device 300 according to this exemplary embodiment. While in the feeding device 200 in the first exemplary embodiment, the side guide mechanism 226 for regulating the width direction of the sheet P is provided in the feeding portion 220, the feeding device 300 is such that a side guide mechanism 216 for regulating the width direction of a recording sheet P is provided on a placement portion 210.

According to this exemplary embodiment, since the length of guides for regulating the width direction of the sheet P can be extended longer, the guiding performance of the guide mechanism can be enhanced.

Third Exemplary Embodiment

Next, a third exemplary embodiment of a feeding device of a conveying apparatus according to the invention will be described. Note that like reference numerals will be given to like configurations to those described in the first exemplary embodiment, so as to omit the description thereof.

Figure 6:
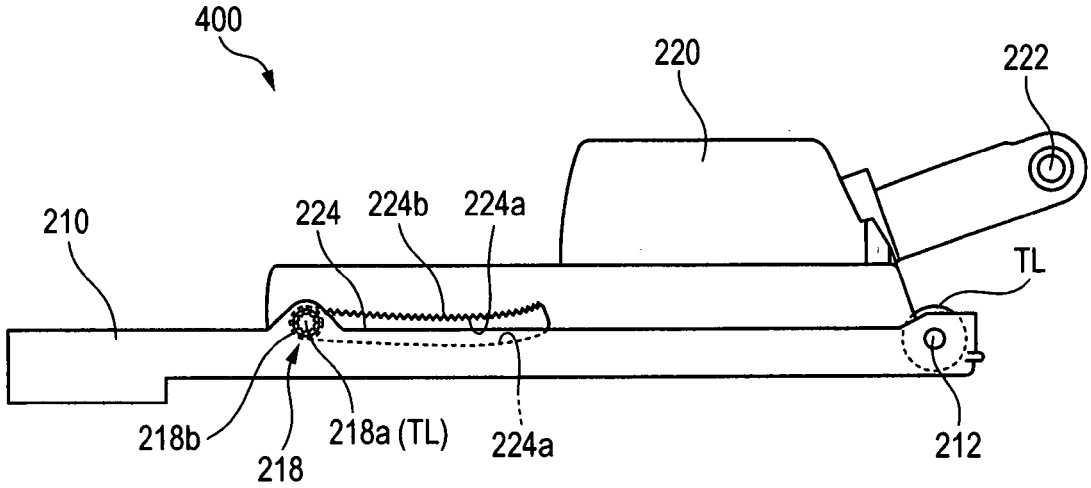
FIG. 6 is a side view showing a feeding device according to a third exemplary embodiment, wherein A denotes an image forming apparatus; 100 denotes an image forming apparatus main body; 200, 300 and 400 denote a feeding device; 210 denotes a placement portion; 220 denotes a feeding portion; 212 denotes a first fulcrum; 222 denotes a second fulcrum; 214 and 218 denote a slide pin; 224 denotes a guide groove; 216 and 226 denote a side guide mechanism; 218*a* denotes a slide pin main body; 218*b* denotes a gear; 224*b* denotes a rack; W denotes a electric wire; TL denotes torque limiter; and P denotes a sheet.

FIG. 6 is a side view showing a feeding device 400 according to this exemplary embodiment. While in the feeding device 200 in the first exemplary embodiment, the torque limiter TL is provided on the first fulcrum 212 round which the placement portion 210 is supported in such a manner as to move rotationally relative to the image forming apparatus main body 100 and/or the second fulcrum 222 round which the feeding portion 220 is supported in such a manner as to move rotationally relative to the image forming apparatus main body 100 so that the predetermined braking torque is generated when the placement portion 210 and the feeding portion 220 rotate, in the feeding device 400, a slide construction is provided which has a guide groove 224 formed in a feeding portion 220 and a slide pin 218 provided on a placement portion 210 in such a manner as to be fitted slidably in the guide groove 224 in the feeding portion 220, wherein a rack 224*b* is formed on an edge which makes up a longitudinal direction of the guide groove 224 formed in the feeding portion 220, and the slide pin 218 is made up of a slide pin main body 218*a* and a gear 218*b* provided on the slide pin main body 218*a* via a torque limiter TL in such a manner as to be brought into mesh engagement with the rack 224*b* formed in the guide groove 224.

According to this exemplary embodiment, as with the first exemplary embodiment, a drastic fall of the placement portion 210 and feeding portion 220 can be prevented that would otherwise occur when the placement portion 210 and the feeding portion 220 rotates from a second position and a fourth position to a first position and a third position, respectively.

Note that while in the exemplary embodiments, the invention has been described as being applied to the image forming apparatus, the invention is not such as to be applied to only the image forming apparatus but can be applied to a card reader, a banknote counter and the like.

What is claimed is:

1. A conveying apparatus comprising:

a conveying apparatus main body; and a feeding device including:

a placement portion that a conveyed material is placed on; and a feeding portion that feeds the conveyed material into the conveying apparatus main body, the feeding device being movable between a feedable position and a stored position;

the placement portion and the feeding portion moving relatively to each other between the feedable position and the stored position through a sliding construction, wherein the placement portion rotationally moves on a first fulcrum, the feeding portion rotationally moves on a second fulcrum, and the second fulcrum lies in a different position from the first fulcrum, wherein the feeding portion includes a plurality of feeding members and a coupling member, and the feeding members are coupled to the coupling member so that relative positions among the feeding members are kept the same, and the feeding members feed the conveyed material into the conveying apparatus main body through a gap between the first fulcrum and the second fulcrum, wherein the sliding construction includes a guide groove formed in the feeding portion and a slide pin connected to the placement portion and slidably fitted in the guide groove to allow the placement portion to slide relative to the feeding portion, and a vertical section of the feeding portion in a longitudinal direction of the guide groove has a concave shape, wherein a torque limiter is located on the second fulcrum.

2. A conveying apparatus comprising:

a conveying apparatus main body; and a feeding device including:

a placement portion that a conveyed material is placed on and that rotationally moves on a first fulcrum;

a feeding portion that feeds the conveyed material into the conveying apparatus main body and that rotationally moves on a second fulcrum; and a position-controlling member that connects the placement portion and the feeding portion, the feeding device being movable between a feedable position and a stored position;

the second fulcrum lying in a different position from the first fulcrum;

the position-controlling member controlling relative positions of the placement portion and the feeding portion through a sliding construction, wherein the feeding portion includes a plurality of feeding members and a coupling member, and the feeding members are coupled to the coupling member so that relative positions among the feeding members are kept the same, and the feeding members feed the conveyed material into the conveying apparatus main body through a gap between the first fulcrum and the second fulcrum and, wherein the sliding construction includes a guide groove formed in the feeding portion and a slide pin connected to the placement portion and slidably fitted in the guide groove to allow the placement portion to slide relative to the feeding portion, and a vertical section of the feeding portion in a longitudinal direction of the guide groove has a concave shape, wherein a torque limiter is located on the second fulcrum.

3. A conveying apparatus comprising:

a conveying apparatus main body; and a feeding device including:

a placement portion that a conveyed material is placed on; and a feeding portion that feeds the conveyed material into the conveying apparatus main body, the feeding device being movable between a feedable position and a stored position;

the placement portion and the feeding portion moving relatively to each other between the feedable position and the stored position through a sliding construction, wherein the placement portion rotationally moves on a first fulcrum, the feeding portion rotationally moves on a second fulcrum, and the second fulcrum lies in a different position from the first fulcrum, wherein the feeding portion includes a plurality of feeding members and a coupling member, and the feeding members are coupled to the coupling member so that relative positions among the feeding members are kept the same, and the feeding members feed the conveyed material into the conveying apparatus main body through a gap between the first fulcrum and the second fulcrum, wherein the sliding construction includes a guide groove formed in the feeding portion and a slide pin connected to the placement portion and slidably fitted in the guide groove to allow the placement portion to slide relative to the feeding portion, and a vertical section of the feeding portion in a longitudinal direction of the guide groove has a concave shape, wherein the plurality of feeding members include a retarder roller.

* * * * *